US007896655B1

(12) United States Patent
Blasick et al.

(10) Patent No.: US 7,896,655 B1
(45) Date of Patent: Mar. 1, 2011

(54) MULTI-PORT CONNECTOR SYSTEM

(75) Inventors: Francis J. Blasick, Halifax, PA (US); Daron Wallace, Harrisburg, PA (US); Kevin Edward Weidner, Hummelstown, PA (US); Keith Richard Foltz, Duncannon, PA (US); Michael Block, Carlisle, PA (US); David Everts, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/541,252

(22) Filed: Aug. 14, 2009

(51) Int. Cl.
*H01R 12/00* (2006.01)

(52) U.S. Cl. ..... 439/63; 439/581

(58) Field of Classification Search ..... 439/79, 439/80, 63, 579, 581, 246, 248
See application file for complete search history.

(56) References Cited

U.S. PATENT DOCUMENTS 4,697,859 A 10/1987 Fisher, Jr.
5,169,343 A * 12/1992 Andrews ..... 439/607.11
5,217,391 A 6/1993 Fisher et al.
5,516,303 A 5/1996 Yohn et al.
5,738,546 A * 4/1998 Burroughs et al. ..... 439/620.03
5,842,872 A * 12/1998 Hosler et al. ..... 439/63
6,319,016 B1 * 11/2001 Juntwait ..... 439/63
6,719,586 B2 * 4/2004 Weidner ..... 439/581
6,827,608 B2 12/2004 Hall et al.
7,478,475 B2 1/2009 Hall
2002/0031950 A1 * 3/2002 Doutrich et al. ..... 439/625

* cited by examiner

*Primary Examiner*—Michael C Zarroli

(57) ABSTRACT

An electrical connector assembly includes a housing, a connector and a conductor. The housing extends from a mating interface to a back end along a longitudinal axis and from a top side to a mounting interface along a vertical axis. The connector is disposed at the mating interface and is configured to mate with a mating connector. The conductor extends from the electrical connector to the mounting interface to provide a conductive pathway between the mating connector and the circuit board. The conductor includes a mating portion oriented along the longitudinal axis and a mounting portion oriented along the vertical axis. One of the mating portion and the mounting portion includes a bifurcated end having opposing contact tips and the other of the mating portion and the mounting portion includes an interconnection end that is received between the contact tips to electrically couple the mating portion and the mounting portion.

22 Claims, 8 Drawing Sheets

MULTI-PORT CONNECTOR SYSTEM

BACKGROUND OF THE INVENTION

The subject matter herein relates generally to electrical connectors and, more particularly, to electrical connectors that electrically couple circuit boards.

Some known connector systems include connectors mounted to circuit boards. The connectors mate with one another to electrically couple the circuit boards. The connectors may be mounted to motherboards, backplanes, midplanes, and other circuit boards to provide for the communication of data and/or power signals there between. Due to space constraints, some of the circuit boards need to be oriented perpendicularly with respect to other circuit boards. For example, daughterboards are typically oriented perpendicular with respect to a midplane board to which the daughterboards are coupled. In order to orient the daughter and midplane boards perpendicular with respect to one another, at least one of the connectors typically is a right angle connector.

Some known right angle connectors include mating faces that engage a mating face of another connector and mounting faces that engage the circuit board to which the right angle connector is mounted. The mating and mounting faces are perpendicular with respect to one another. The right angle connectors include conductors that extend from the mating face to the mounting face and provide an electronically communicative pathway between the mating and mounting faces. In order to extend between the perpendicularly oriented mating and mounting faces, some conductors include a ninety degree bend within the orthogonal connector. But, the bend in the conductor may impact the electrical impedance characteristic of the connector. For example, the bend in the conductor may locally change a cross-sectional area of the conductor and increase the local electrical impedance characteristic of the conductor. As a result, the connector may have an electrical impedance characteristic that varies through the connector between the mating and mounting faces. Moreover, the space within the right angle connectors may be significantly limiting, thereby increasing the challenge of producing a reliable ninety degree bend in the limited space. Other conductors include two portions that are joined together within the connector by solder. But, the application of solder may vary significantly among conductors and within connectors, thereby introducing impedance variation and reducing the reliability of electrical connections provided by the connector.

Additionally, some right angle connectors are mounted to circuit boards using mounting pins. The mounting pins are coupled with conductors in the connectors. The mounting pins may be press-fit into the circuit boards to retain the pins in the circuit boards. Some known mounting pins are relatively thin and prone to bend or buckle when the connectors are mounted to the circuit boards. For example, the mounting pins may have relatively little mechanical support in directions along the surface of the circuit board. Misalignment of the mounting pins with respect to the circuit board may result in sufficiently large lateral forces being imparted on the mounting pins. These forces may cause the pins to fail by bending or buckling, for example.

A need thus exists for connectors having conductors that provide a more reliable and stable connection between mating and mounting faces that are angled with respect to one another. A need also exists for connectors that have mounting pins that are less prone to buckling when the connectors are mounted to circuit boards.

BRIEF DESCRIPTION OF THE INVENTION

In one embodiment, an electrical connector assembly is provided. The assembly includes a housing, an electrical connector and a conductor. The housing extends from a mating interface to a back end along a longitudinal axis and from a top side to a mounting interface along a vertical axis. The mounting interface is configured to mount the housing to a circuit board. The electrical connector is disposed at the mating interface and is configured to mate with a mating connector. The conductor extends from the electrical connector to the mounting interface to provide a conductive pathway between the mating connector and the circuit board. The conductor includes a mating portion oriented along the longitudinal axis and a mounting portion oriented along the vertical axis. One of the mating portion and the mounting portion includes a bifurcated end having opposing contact tips and the other of the mating portion and the mounting portion includes an interconnection end that is received between the contact tips to electrically couple the mating portion and the mounting portion.

In another embodiment, another electrical connector assembly is provided. The assembly includes a housing, an electrical connector, a dielectric body and a conductor. The housing extends from a mating interface to a mounting interface. The mounting interface is configured to mount the housing to a circuit board. The electrical connector is disposed at the mating interface and is configured to mate with a mating connector. The dielectric body is disposed in the housing at the mounting interface. The dielectric body includes an axial opening that extends along a length of the dielectric body and a slot oriented in an angled direction with respect to the length of the dielectric body. The conductor extends from the electrical connector to the mounting interface to provide a conductive pathway between the mating connector and the circuit board. The conductor includes a mounting pin configured to be mounted to the circuit board and a shoulder extending from the conductor and disposed at an angle with respect to the mounting pin. The shoulder is received into the slot of the dielectric body.

DETAILED DESCRIPTION OF THE INVENTION

Figure 1:
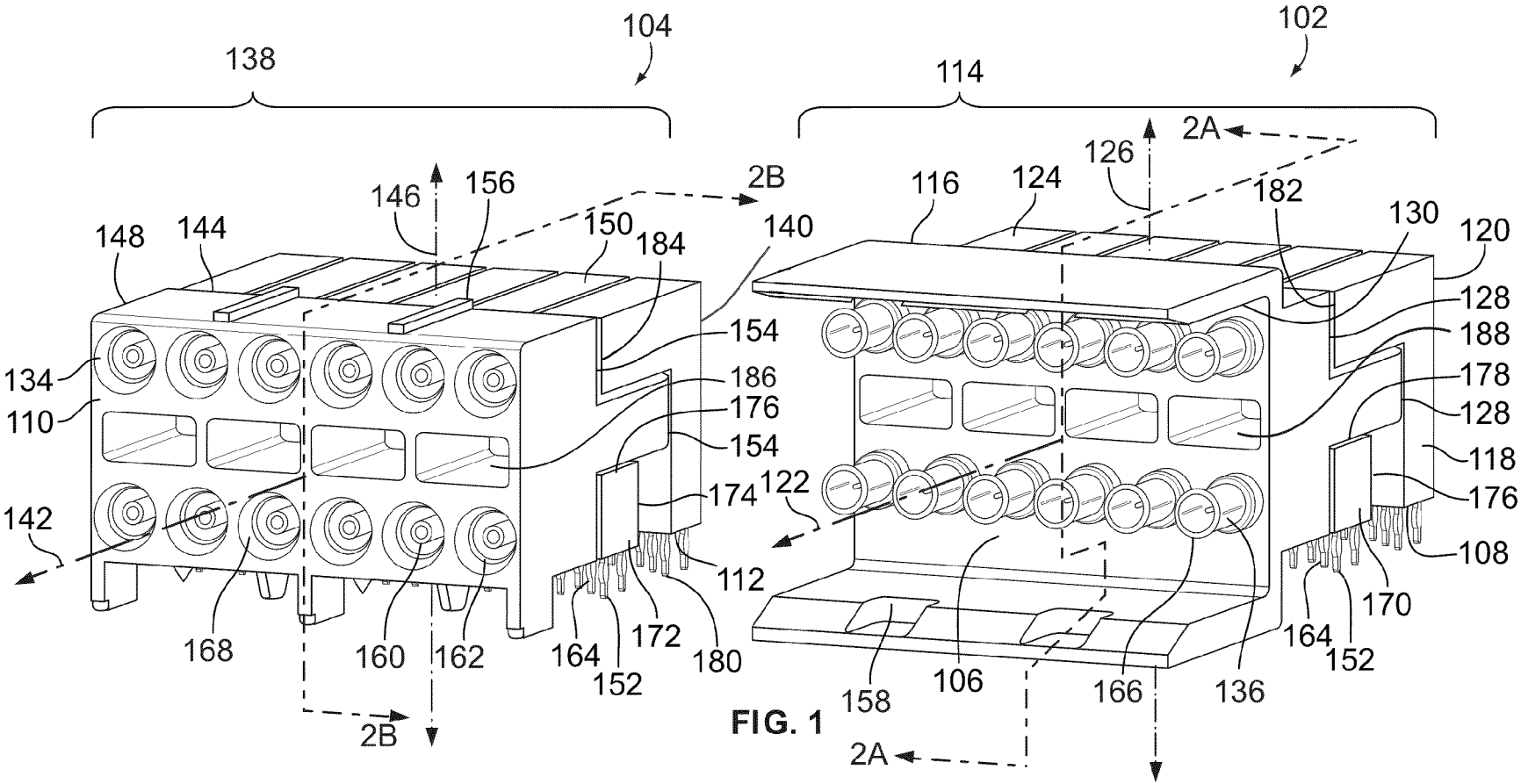
FIG. 1 is a perspective view of a connector system in accordance with one embodiment.

FIG. 1 is a perspective view of a connector system 100 in accordance with one embodiment. The system 100 shown in FIG. 1 is a right angle connector system. The system 100 includes an electrical plug connector assembly 102 and an electrical receptacle connector assembly 104. The plug connector assembly 102 mates with the receptacle connector assembly 104 to electrically couple the plug connector assembly 102 with the receptacle connector assembly 104. Each of the plug connector assembly 102 and the receptacle connector assembly 104 may be mounted to a circuit board (not shown), such as a printed circuit board. In the illustrated embodiment, the plug connector assembly 102 and the receptacle connector assembly 104 are right angle connectors. For example, the plug connector assembly 102 may have a mating interface 106 and a mounting interface 108 that are oriented substantially perpendicular with respect to one another. Similarly, the receptacle connector assembly 104 may have a mating interface 110 and a mounting interface 112 that are oriented substantially perpendicular with respect to one another. The mating interfaces 106, 110 engage one another when the plug connector assembly 102 and receptacle connector assembly 104 mate with each other. The circuit boards to which the plug connector assembly 102 and the receptacle connector assembly 104 are mounted are oriented approximately parallel or coplanar with respect to one another when the plug connector assembly 102 mates with the receptacle connector assembly 104.

The mounting interfaces 108, 112 engage separate circuit boards (not shown) such that the system 100 electronically joins the separate circuit boards through the plug connector assembly 102 and the receptacle connector assembly 104. In the illustrated embodiment, each of the plug connector assembly 102 and the receptacle connector assembly 104 includes mounting pins 152, 164, 180 that project from the mounting interfaces 108, 112. The mounting pins 152, 164, 180 may be compliant eye-of-needle pins that are pressed into a circuit board to mount the plug connector assembly 102 and the receptacle connector assembly 104 to the circuit boards. The mounting pins 152 of the plug connector assembly 102 and the mounting pins 152 of the receptacle connector assembly 104 are grounding pins that electrically couple the plug connectors 132, 166 and receptacle connectors 134, 168, respectively, to an electrical ground reference of the circuit boards. The mounting pins 164 of the plug connector assembly 102 and the mounting pins 180 of the receptacle connector assembly 104 are signal pins that electrically couple the plug connectors 132, 166 and receptacle connectors 134, 168, respectively, with the circuit board to communicate data signals between the circuit boards and the plug connector assembly 102 and the receptacle connector assembly 104.

The plug connector assembly 102 includes a two-piece housing 114 that extends from the mating interface 106 to a back end 120 along a longitudinal axis 122. Alternatively, the housing 114 may be formed as a single piece unitary housing. The housing 114 also extends from the mounting interface 108 to a top side 124 along a vertical axis 126. In the illustrated embodiment, the longitudinal axis 122 and vertical axis 126 are oriented perpendicular to one another. The housing 114 is comprised of a header assembly 116 and several connector modules 118, 170.

The header assembly 116 may include, or be formed from, a dielectric material, such as a polymer. Alternatively, the header assembly 116 may include, or be formed from, a conductive material. In the illustrated embodiment, the header assembly 116 includes voids or corings 188. The corings 188 are recesses that extend into the header assembly 116 from the mating interface 106 to reduce the amount of material used to fabricate the header assembly 116. The header assembly 116 extends from the mating interface 106 to a rear face 128 along the longitudinal axis 122. Additional corings 188 may be extend from the rear face 128 toward the mating interface 106. In the illustrated embodiment, the rear face 128 is a non-planar face. For example, the rear face 128 is not entirely disposed in a single plane. Alternatively, the rear face 128 may be entirely disposed in a single plane. The header assembly 116 includes an alignment shroud 130 that projects from the mating interface 106 in a direction that is substantially parallel to the longitudinal axis 122. The alignment shroud 130 engages the receptacle connector assembly 104 to align the plug connector assembly 102 with the receptacle connector assembly 104.

The connector modules 118, 170 include, or are formed from, a conductive material, such as a metal or metal alloy. Alternatively, the connector modules 118, 170 may include, or be formed from, a dielectric material. The connector modules 118 extend from a front face 182 to the back end 120 in directions along the longitudinal axis 122 and from the top side 124 to the mounting interface 108 in directions along the vertical axis 126. The connector modules 170 extend from the front face 182 to a back end 176 in directions along the longitudinal axis 122 and between a top side 178 and the mounting interface 108 in directions along the vertical axis 126. In the illustrated embodiment, the front face 182 is disposed proximate to the rear face 128 of the header assembly 116. The front face 182 may be adjacent to the rear face 128 or may be separated from the rear face 128.

Several plug connectors 132, 166 are disposed at the mating interface 106. The plug connectors 132 are located along an upper row at the mating interface 106 while the plug connectors 166 are located along a lower row at the mating interface 106. The plug connectors 132, 166 engage and mate with receptacle connectors 134, 168 of the receptacle connector assembly 104 to electrically couple the plug connector assembly 102 with the receptacle connector assembly 104. In the illustrated embodiment, the plug connectors 132, 166 are coaxial connectors. For example, each of the plug connectors 132, 166 may include a center conductor 200 (shown in FIG. 2) that is circumferentially surrounded by a conductive shield shell 136. The plug connectors 132, 166 forwardly project from the mating interface 106 in directions along the longitudinal axis 122. In an alternative embodiment, the plug connectors 132, 166 are connectors other than coaxial connectors. In the illustrated embodiment, a separate connector module 118, 170 is provided for each plug connector 132, 166. For example, a single upper connector module 118 may be provided for each plug connector 132 and a single lower connector module 170 may be provided for each plug connector 166. As described below, each connector module 118, 170 holds the center conductor 160, 200 of a different plug connector 132, 166.

The receptacle connector assembly 104 includes a housing 138 that extends from the mating interface 110 to a back end 140 along a longitudinal axis 142. The housing 138 also extends from the mounting interface 112 to a top side 144 along a vertical axis 146. Similar to the longitudinal axis 122 and vertical axis 126 of the plug connector assembly 102, the longitudinal axis 142 and vertical axis 146 of the receptacle connector assembly 104 may be oriented perpendicular to one another. The housing 138 includes a header assembly 148 and several connector modules 150, 172.

The header assembly 148 includes, or is formed from, a dielectric material, such as a polymer. Alternatively, the header assembly 148 includes, or is formed from, a conductive material. In the illustrated embodiment, the header assembly 148 includes voids or corings 186. The corings 186 are recesses that extend into the header assembly 148 from the mating interface 110 to reduce the amount of material used to fabricate the header assembly 148. The header assembly 148 extends from the mating interface 110 to a rear face 154 along the longitudinal axis 142. Additional corings 186 may be extend from the rear face 154 toward the mating interface 110. Similar to the rear face 128 of the plug connector assembly 102, the rear face 154 may be a non-planar face. Alternatively, the rear face 154 may be a planar face that is entirely disposed in a single plane. The header assembly 148 includes alignment features 156 that engage the alignment shroud 130 to align the receptacle connectors 134, 168 with the plug connectors 132, 166. The alignment features 156 are extensions of the header assembly 148 that are received in slots 158 of the header assembly 116. The shroud 130 of the plug connector assembly 102 may project from the mating interface 106 of the plug connector assembly 102 such that the slots 158 engage the alignment features 156 to align the plug connectors 132, 166 with the receptacle connectors 134, 168 prior to the plug connectors 132, 166 being received into the receptacle connectors 134, 168.

Similar to the connector modules 118, 170 of the plug connector assembly 102, the connector modules 150, 172 include, or are formed from, a conductive material, such as a metal or metal alloy. Alternatively, the connector modules 150, 172 include, or are formed from, a dielectric material. The connector modules 150 extend from a front face 184 to the back end 140 in directions along the longitudinal axis 142 and from the top side 144 to the mounting interface 112 in directions along the vertical axis 146. The connector modules 172 extend from the front face 184 to a back end 174 in directions along the longitudinal axis 142 and from a top side 176 to the mounting interface 112 in directions along the vertical axis 146, in the illustrated embodiment, the front face 184 is disposed proximate to the rear face 154 of the header assembly 148. The front face 184 may be adjacent to the rear face 154 or may be separated from the rear face 154.

The receptacle connectors 134 are disposed in an upper row at the mating interface 110 and the receptacle connectors 168 are located in a lower row at the mating interface 110. The receptacle connectors 134, 168 receive and mate with the plug connectors 132, 166 of the plug connector assembly 102 to electrically couple the plug connector assembly 102 with the receptacle connector assembly 104. In the illustrated embodiment, the receptacle connectors 134, 168 are coaxial connectors. For example, each of the receptacle connectors 134, 168 may include a center conductor 160 that is circumferentially surrounded by a conductive shield shell 162. The center conductor 160 includes, or is formed from, a conductive material, such as a metal or metal alloy. The center conductor 160 communicates data and/or power signals through the corresponding receptacle connector 134, 168. The shield shell 162 also includes, or is formed from, a conductive material. The shield shell 162 shields the center conductor 160 from electromagnetic interference. For example, the shield shell 162 may be electrically joined to a ground reference of a circuit board (not shown) through one or more of the connector modules 150, 172 to dissipate electromagnetic interference. The plug connectors 132, 166 are received into the receptacle connectors 134, 168 through the mating interface 110. In an alternative embodiment, the receptacle connectors 134, 168 are connectors other than coaxial connectors. In the illustrated embodiment, a separate connector module 150, 172 is provided for each receptacle connector 134, 168. Each connector module 150, 172 may hold the center conductor 160 of a different receptacle connector 134, 168.

Figure 2:
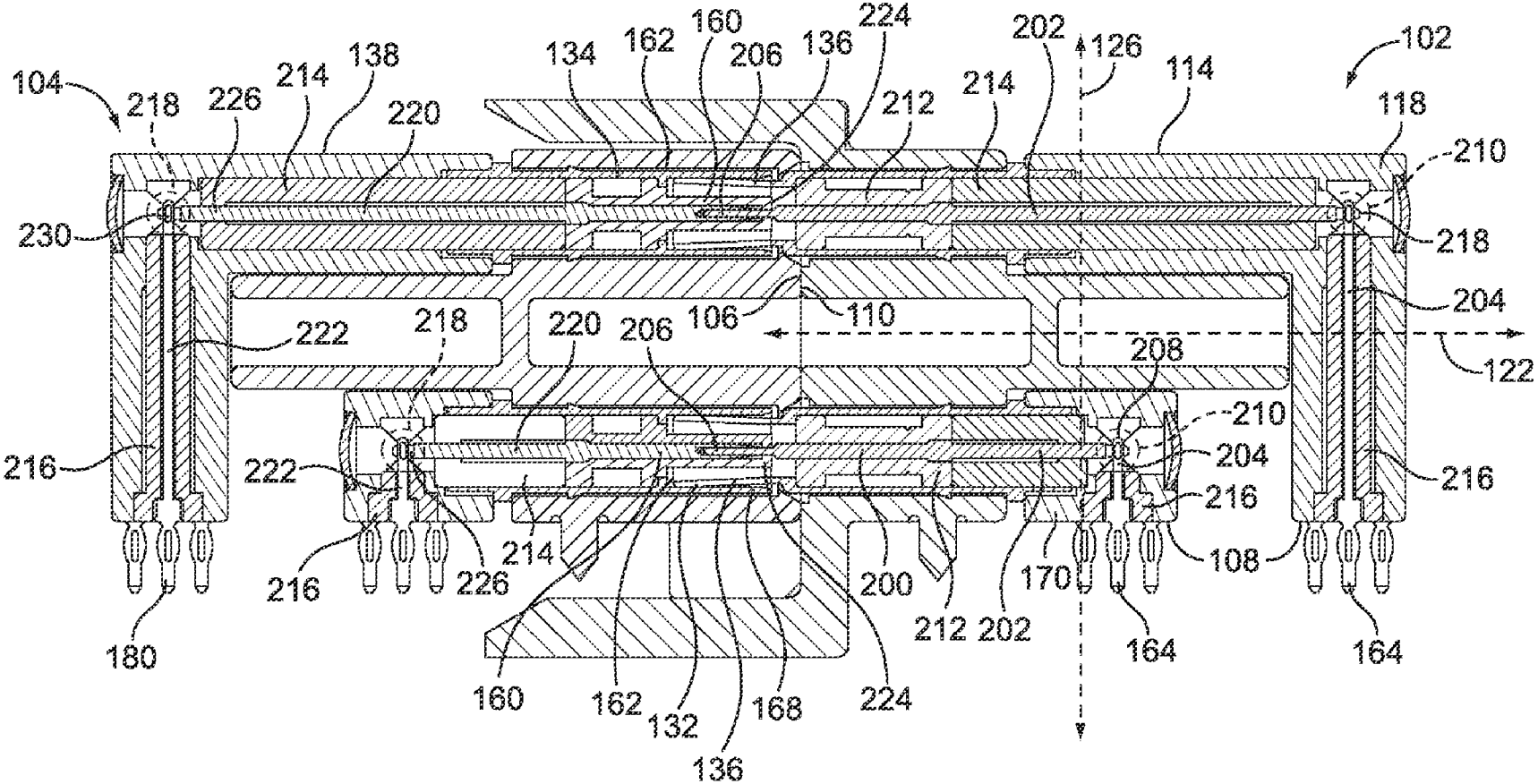
FIG. 2 is a cross-sectional view of the plug connector assembly shown in FIG. 1 in accordance with one embodiment.

FIG. 2 is a cross-sectional view of the plug connector assembly 102 mated with the receptacle connector assembly 104 taken along line 2A-2A of the plug connector assembly 102 and line 2B-2B of the receptacle connector assembly 104 in FIG. 1 in accordance with one embodiment. As described above, the plug connectors 132, 166 and receptacle connectors 134, 168 are coaxial connectors in one embodiment. The plug connectors 132, 166 include center conductors 200 that are at least partially surrounded by shield shells 136 and the receptacle connectors 134, 168 include center conductors 160 that are at least partially surrounded by shield shells 162. The center conductor 200 includes, or is formed from, a conductive material, such as a metal or metal alloy. The center conductor 200 communicates data and/or power signals through the corresponding plug connector 132, 166. The shield shell 136 also includes, or is formed from, a conductive material. The shield shell 136 shields the center conductor 200 from electromagnetic interference. For example, the shield shell 136 may be electrically joined to a ground reference of a circuit board (not shown) through one or more of the connector modules 118, 170 to dissipate electromagnetic interference.

The center conductors 200 of the plug connectors 132, 166 extend from locations that are proximate to the mating interface 106 and to the mounting interface 108. The center conductors 200 of the plug connectors 132, 166 include an angled interconnection 210. The angled interconnection 210 is the intersection of a mating portion 202 and a mounting portion 204 of each center conductor 200. The mating portions 202 are coupled to the mounting portions 204 at the angled interconnections 210. As shown in FIG. 2, the angled interconnections 210 may be right angle interconnections of the mating portions 202 and the mounting portions 204. For example, the mating portion 202 may be oriented along the longitudinal axis 122 of the plug connector assembly 102 and the mounting portion 204 may be oriented along the vertical axis 126 of the plug connector assembly 102.

The mating portions 202 extend through the corresponding connector modules 118, 170 from outer ends 206 to bifurcated ends 208. The outer ends 206 may be contact pins that are received in the center conductors 160 of the corresponding receptacle connectors 134, 168 when the receptacle connectors 134, 168 and plug connectors 132, 166 mate with one another. The mounting portions 204 extend through the corresponding connector modules 118, 170 from interconnection ends 228 to the mounting pins 164. The bifurcated ends 208 and interconnection ends 228 are joined together at the angled interconnections 210 to establish an electrically conductive pathway between the outer ends 206 and the mounting pins 164. As shown in FIG. 2, the mating portions 202 of the plug connectors 132 may be substantially similar to the mating portions 202 of the plug connectors 166, with the mating portions 202 of the plug connectors 166 being shorter in length than the mating portions 202 of the plug connectors 132. Also as shown in FIG. 2, the mounting portions 204 of the plug connectors 132 may be substantially similar to the mounting portions 204 of the plug connectors 166, with the mounting portions 204 of the plug connectors 166 being shorter in length than the mounting portions 204 of the plug connectors 132.

The housing 114 of the plug connector assembly 102 includes several dielectric bodies 212, 214, 216 that encircle the center conductor 200 along separate and different lengths of the center conductor 200. The dielectric bodies 212, 214, 216 include, or are formed from, an electrically insulative material such as a polymer. The dielectric bodies 212, 214, 216 separate and electrically isolate the center conductor 200 from other conductive components in the housing 114. For example, a forward dielectric body 212 separates the center conductor 200 from the shield shell 136, a rear dielectric body 214 separates the center conductor 200 from the corresponding connector module 118, 170, and a vertical dielectric body 216 separates the center conductor 200 from the corresponding connector module 118, 170. As shown in FIG. 2, the front and rear dielectric bodies 212, 214 are oriented in directions along the longitudinal axis 122 while the vertical dielectric body 216 is oriented in a direction along the vertical axis 126. The dielectric bodies 212, 214, 216 that encircle the center conductors 200 of the plug connectors 132 are similar to the dielectric bodies 212, 214, 216 that encircle the center conductor 200 of the plug connectors 166. One difference between the dielectric bodies 212, 214, 216 of the plug connectors 132 and of the plug connectors 166 is that the dielectric bodies 212, 214, 216 of the plug connectors 166 have a shorter length. In another embodiment, one or more of the dielectric bodies 212, 214, 216 may be replaced by an air gap that spatially separates and insulates the center conductors 160 from the shield shells 162.

The center conductors 160 of the receptacle connectors 134, 168 extend from locations that are proximate to the mating interface 110 and to the mounting interface 112 of the receptacle connector assembly 104. The center conductors 160 include an angled interconnection 218 that is similar to the angled interconnection 210 of the plug connectors 132, 166. The angled interconnection 218 is the intersection of a mating portion 220 and a mounting portion 222 of each center conductor 160. The mating portions 220 are coupled to the mounting portions 222 at the angled interconnections 218. The angled interconnections 218 may be right angle interconnections of the mating portions 220 and the mounting portions 222 similar to the angled interconnections 210.

The mating portions 220 extend through the corresponding connector modules 150, 172 from outer ends 224 to bifurcated ends 226. The outer ends 224 may be hollow, tubular bodies that receive the outer ends 206 of the center conductors 200 in the corresponding plug connectors 132, 166. The mounting portions 222 extend through the corresponding connector modules 150, 172 from interconnection ends 230 to the mounting pins 180. The bifurcated ends 226 and interconnection ends 230 are joined together at the angled interconnections 218 to establish an electrically conductive pathway between the outer ends 224 and the mounting pins 180. As shown in FIG. 2, the mating portions 220 of the receptacle connectors 134 may be substantially similar to the mating portions 220 of the receptacle connectors 168, with the mating portions 220 of the receptacle connectors 134 being longer in length than the mating portions 220 of the receptacle connectors 168. The mounting portions 222 of the receptacle connectors 134 may be substantially similar to the mounting portions 222 of the receptacle connectors 168, with the mounting portions 222 of the receptacle connectors 134 being longer in length than the mounting portions 222 of the receptacle connectors 168.

The housing 138 of the receptacle connector assembly 104 includes the dielectric bodies 214, 216 that encircle the center conductor 160 in a manner similar to the center conductor 200. For example, each of the dielectric bodies 214, 216 encloses a different length of the center conductor 160.

Figure 3:
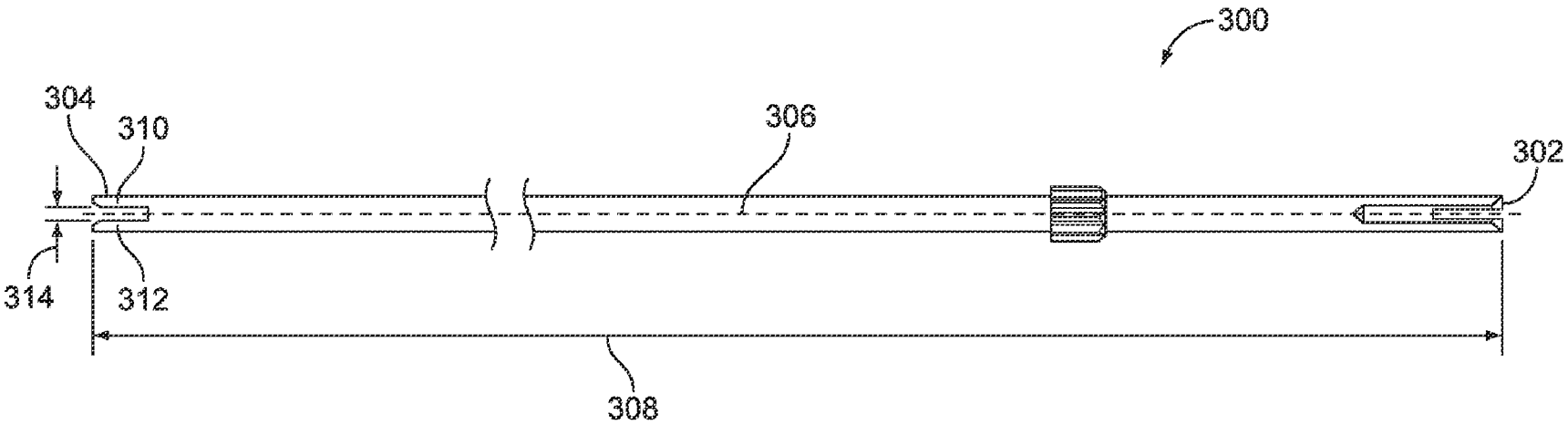
FIG. 3 is a cross-sectional view of a mating portion of a center conductor in accordance with one embodiment.

FIG. 3 is a cross-sectional view of a mating portion 300 of a center conductor in accordance with one embodiment. The mating portion 300 may be used as the mating portion 220 (shown in FIG. 2) of the center conductor 160 for the receptacle connectors 134 (shown in FIG. 1) and/or the receptacle connectors 168 (shown in FIG. 1). The mating portion 300 extends from an outer end 302 to a bifurcated end 304 along a longitudinal axis 306. A length dimension 308 of the mating portion 300 is the distance between the outer end 302 and the bifurcated end 304 in a direction along the longitudinal axis 306. The length dimension 308 may be varied in order to accommodate the different receptacle connectors 134, 168. For example, the length dimension 308 may be increased in an embodiment where the mating portion 300 is included in the receptacle connectors 134 and decreased in an embodiment where the mating portion 300 is included in the receptacle connectors 168. The outer end 302 is similar to the outer end 224 (shown in FIG. 2) in the illustrated embodiment. For example, the outer end 302 may include a hollow, tubular body that receives the outer end 206 (shown in FIG. 2) of the plug connectors 132, 166 (shown in FIG. 1).

The bifurcated end 304 may be similar to the bifurcated end 226 (shown in FIG. 2). For example, the bifurcated end 304 may be coupled with the mounting portion 222 (shown in FIG. 2) at the angled interconnection 218 (shown in FIG. 2) to electrically join the mating portion 300 with the mounting portion 222. The bifurcated end 304 includes opposing contact tips 310, 312 that are oriented along the longitudinal axis 306. The contact tips 310, 312 are separated from one another by a gap 314 in a direction that is angled with respect to the longitudinal axis 306. For example, the contact tips 310, 312 may be separated from one another in a direction that is perpendicular to the longitudinal axis 306. Alternatively, the contact tips 310, 312 are partially closed towards one another relative to the illustrated embodiment. In one embodiment, the bifurcated end 208 (shown in FIG. 2) of the mating portion 202 (shown in FIG. 2) for the plug connectors 132, 166 (shown in FIG. 1) is similar to the bifurcated end 304. For example, the bifurcated end 208 may have similar dimensions and size as the bifurcated end 304.

Figure 4:
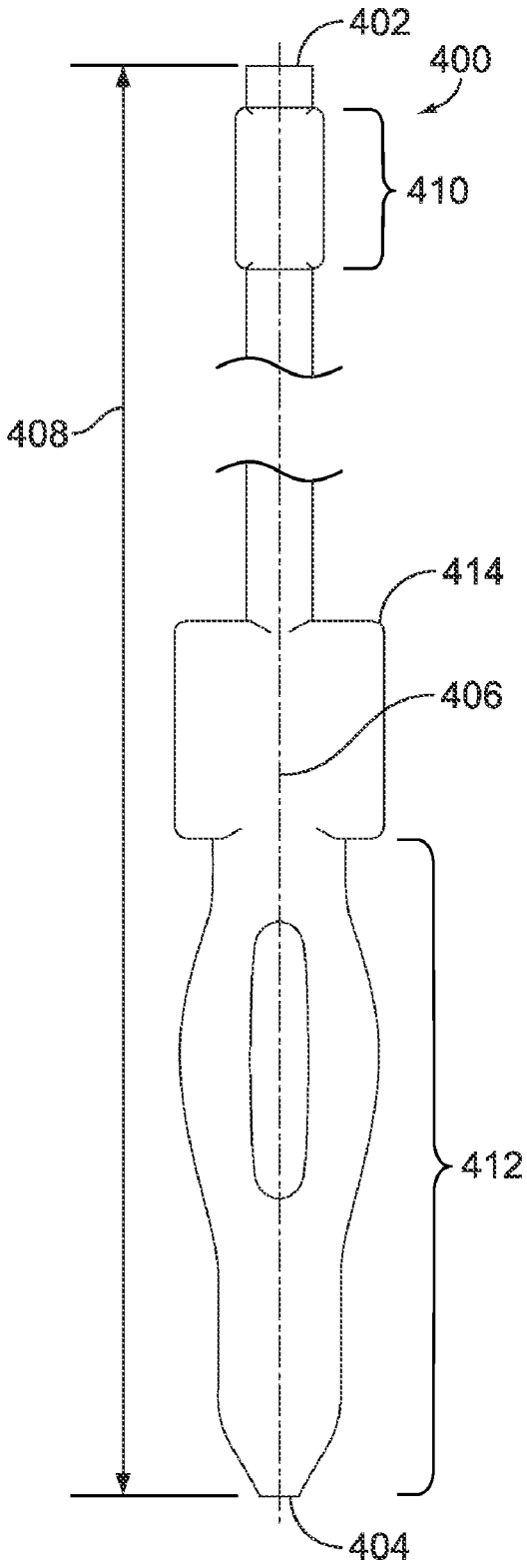
FIG. 4 is a cross-sectional view of a mounting portion of a center conductor in accordance with one embodiment.
Figure 5:
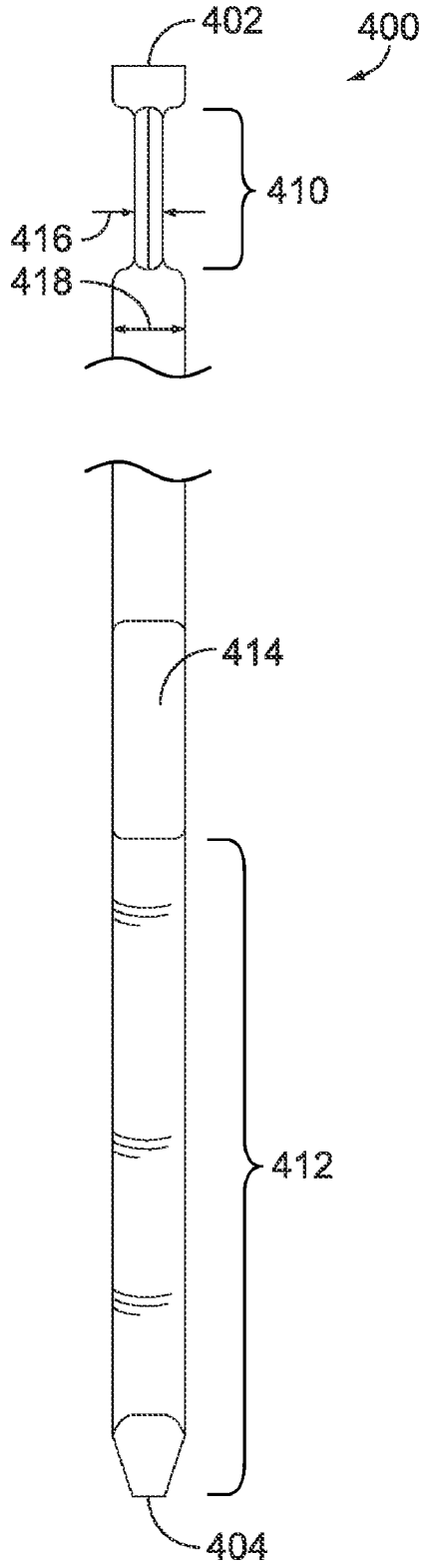
FIG. 5 is a side view of the mounting portion shown in FIG. 4 in accordance with one embodiment.

FIG. 4 is a cross-sectional view of a mounting portion 400 of a center conductor in accordance with one embodiment. FIG. 5 is a side view of the mounting portion 400 in accordance with one embodiment. The mounting portion 400 may be used as the mounting portion 222 (shown in FIG. 2) of the center conductor 160 for the receptacle connectors 134 (shown in FIG. 1) and/or the receptacle connectors 168 (shown in FIG. 1). In one embodiment, the mounting portion 400 may be used as the mounting portion 204 (shown in FIG. 2) of the plug connectors 132, 166 (shown in FIG. 1).

The mounting portion 400 extends from an interconnection end 402 to a mounting end 404 along a longitudinal axis 406. A length dimension 408 of the mounting portion 400 is the distance between the interconnection end 402 and the mounting end 404 in a direction along the longitudinal axis 406. The length dimension 408 may be varied in order to accommodate the different receptacle connectors 134, 168. For example, the length dimension 408 may be increased in an embodiment where the mounting portion 400 is included in the receptacle connectors 134 and decreased in an embodiment where the mounting portion 400 is included in the receptacle connectors 168.

The interconnection end 402 includes a coupling section 410 that is received between the contact tips 310, 312 (shown in FIG. 3) of the mating portion 300 (shown in FIG. 3). For example, the coupling section 410 may be loaded into the gap 314 (shown in FIG. 3) between the contact tips 310, 312. As shown in FIG. 5, the coupling section 410 has a thickness dimension 416 that is less than a thickness dimension 418 of the mounting portion 400.

The contact tips 310, 312 may be biased or bent toward one another before the coupling section 410 is placed between the tips 310, 312. For example, the contact tips 310, 312 may be close enough to one another such that loading the coupling section 410 between the contact tips 310, 312 causes the contact tips 310, 312 to be biased away from one another. Loading the coupling section 410 between the contact tips 310, 312 may cause the contact tips 310, 312 to frictionally engage and secure the coupling section 410 between the contact tips 310, 312. In one embodiment, after the coupling section 410 is placed between the contact tips 310, 312, the contact tips 310, 312 may be bent toward one another to secure the coupling section 410 between the contact tips 310, 312. The coupling section 410 is received between the contact tips 310, 312 at the angled interconnection 218 (shown in FIG. 2) to join and electrically couple the mating portion 300 with the mounting portion 400. The engagement of both contact tips 310, 312 on the coupling section 410 may electrically join the mating portion 300 and mounting portion 400 without significantly increasing the local electrical impedance characteristic of the mating portion 300 and mounting portion 400. As shown in FIG. 2, the joining of the coupling section 410 of the mounting portion 400 with the contact tips 310, 312 at the bifurcated end 304 (shown in FIG. 3) of the mating portion 300 may orient the mounting portion 400 and mating portion 300 at an angle with respect to one another. For example, the mating portion 300 may be perpendicular to the mounting portion 400.

Alternatively, the mounting portion 400 may include a bifurcated end that is similar to the bifurcated end 304 (shown in FIG. 3) of the mating portion 300 (shown in FIG. 3) and the mating portion 300 may include an interconnection end that is similar to the interconnection end 402 of the mounting portion 400. For example, the features of the mounting portion 400 and mating portion 300 that are used to couple the mounting portion 400 and the mating portion 300 together may be switched. In such an embodiment, the interconnection end of the mating portion 300 is received within the bifurcated end of the mounting portion 400 similar to as described above.

The mounting end 404 includes a mounting pin 412 that may be inserted into a circuit board (not shown) to electrically couple the mounting portion 400 with the circuit board. In the illustrated embodiment, the mounting pin 412 is an eye-of-needle pin that is press-fit into a hole in a circuit board. The mounting pin 412 is oriented along the longitudinal axis 406 and includes a shoulder 414 between the mounting end 404 and the coupling section 410. The shoulder 414 protrudes from the mounting portion 400 in a direction that is angled with respect to the longitudinal axis 406. For example, the shoulder 414 may extend from the mounting portion 400 in a direction perpendicular to the longitudinal axis 406. In an embodiment where the mounting portion 400 is used as the mounting portion 222 (shown in FIG. 2), the shoulder 414 may protrude from the mounting portion 400 in a direction that is angled with respect to the vertical axis 146 (shown in FIG. 1) of the receptacle connector assembly 104 (shown in FIG. 1).

Figure 6:
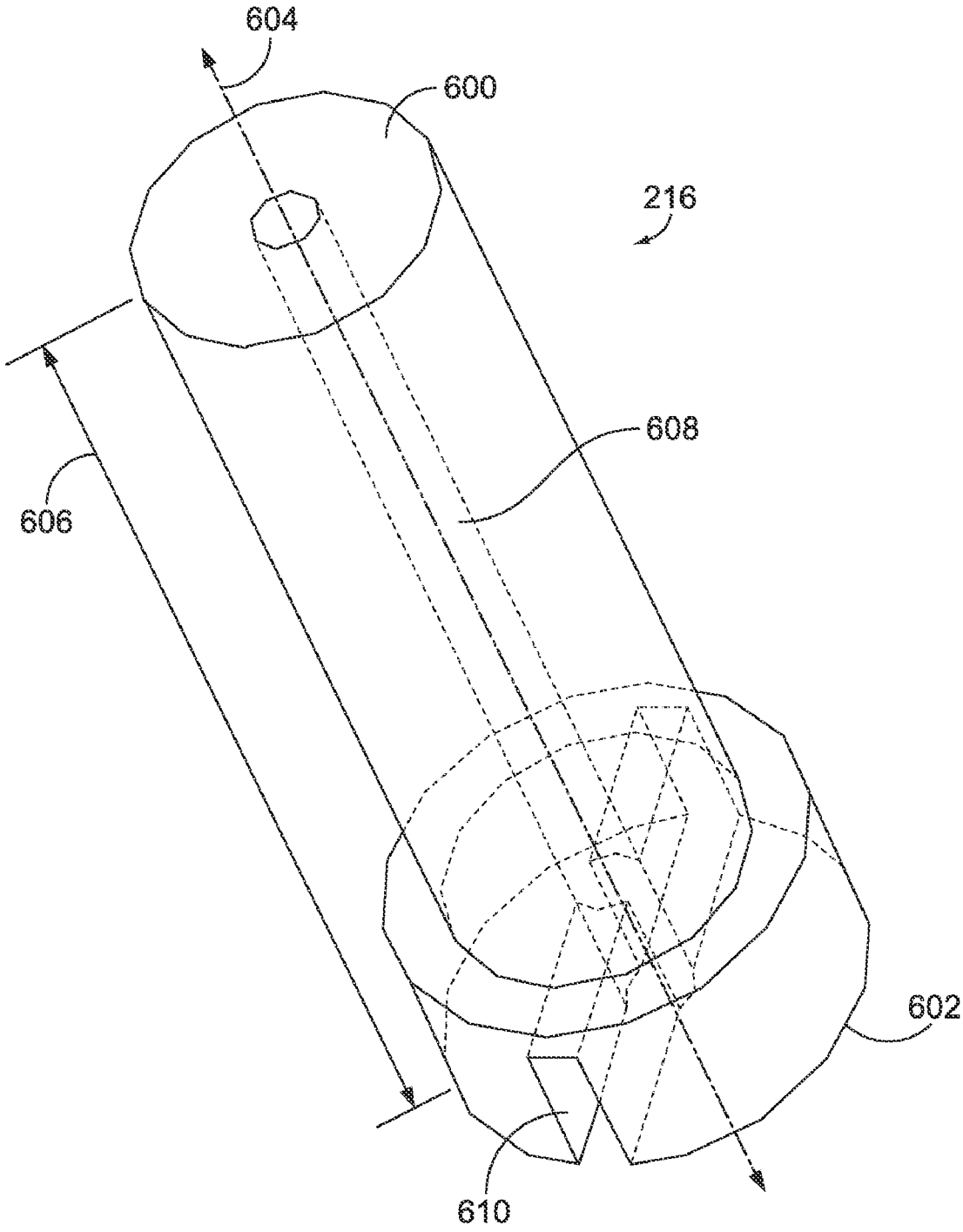
FIG. 6 is a perspective view of a dielectric body shown in FIG. 2 of the plug connector assembly and/or the receptacle connector assembly 104 shown in FIG. 1 in accordance with one embodiment.

FIG. 6 is a perspective view of the dielectric body 216 of the plug connector assembly 102 (shown in FIG. 1) and/or the receptacle connector assembly 104 (shown in FIG. 1) in accordance with one embodiment. The dielectric body 216 is shown in phantom to more clearly illustrate the shape and dimensions of the dielectric body 216. As described above, the dielectric body 216 includes, or is formed from, an electrically insulative material to physically separate and electrically isolate the center conductors 160 (shown in FIG. 1) and/or 200 (shown in FIG. 2) from other conductive components in the plug connector assembly 102 and/or the receptacle connector assembly 104.

The dielectric body 216 is elongated between a top end 600 and a bottom end 602 along a center axis 604. In one embodiment, the dielectric body 216 is disposed in the plug connector assembly 102 (shown in FIG. 1) and/or the receptacle connector assembly 104 (shown in FIG. 1) such that the center axis 604 is substantially parallel to the vertical axis 126 (shown in FIG. 1) of the plug connector assembly 102 and/or the vertical axis 146 (shown in FIG. 1) of the receptacle connector assembly 104. A length dimension 606 is the distance between the top end 600 and the bottom end 602 along the center axis 604. The length dimension 606 may be varied in order to accommodate the different receptacle connectors 134, 168 (shown in FIG. 1) and/or plug connectors 132, 166 (shown in FIG. 1). For example, the length dimension 606 may be increased in an embodiment where the dielectric body 216 is included in the receptacle connectors 134 and/or the plug connectors 132 and decreased in an embodiment where the dielectric body 216 is included in the receptacle connectors 168 and/or the plug connectors 166.

An axial opening 608 is an opening extending through the length dimension 606 of the dielectric body 216 from the top end 600 to the bottom end 602. In the illustrated embodiment, the axial opening 608 extends through the dielectric body 216 in a direction along the center axis 604. The mounting portion 204, 222 extends through the axial opening 608. The dielectric body 216 physically separates and electrically isolates the mounting portion 204, 222, and may isolate the center conductor 160, 200, from other conductive components in the plug connector assembly 102 (shown in FIG. 1) or the receptacle connector assembly 104 (shown in FIG. 1) along the length dimension 606 of the dielectric body 216.

The bottom end 602 includes a slot 610 that extends through the dielectric body 216 at an angle with respect to the center axis 604. For example, the slot 610 may extend through the dielectric body 216 at a perpendicular angle with respect to the center axis 604. The slot 610 is a cavity in the dielectric body 216 that receives the shoulder 414 (shown in FIG. 4) of the mounting portion 400 (shown in FIG. 4). The shoulder 414 is loaded into the slot 610 to provide lateral support to the mounting pin 412 (shown in FIG. 4). For example, the shoulder 414 is placed into the slot 610 such that the dielectric body 216 laterally supports the mounting pin 412 in directions that are angled with respect to the longitudinal axis 406 (shown in FIG. 4). The dielectric body 216 may support the mounting pin 412 by providing additional mechanical strength to the mounting pin 412 when the mounting pin 412 is mounted to a circuit board (not shown). The additional mechanical strength may prevent the mounting pin 412 from bending or buckling when the mounting pin 412 is press-fit into the circuit board.

Figure 7:
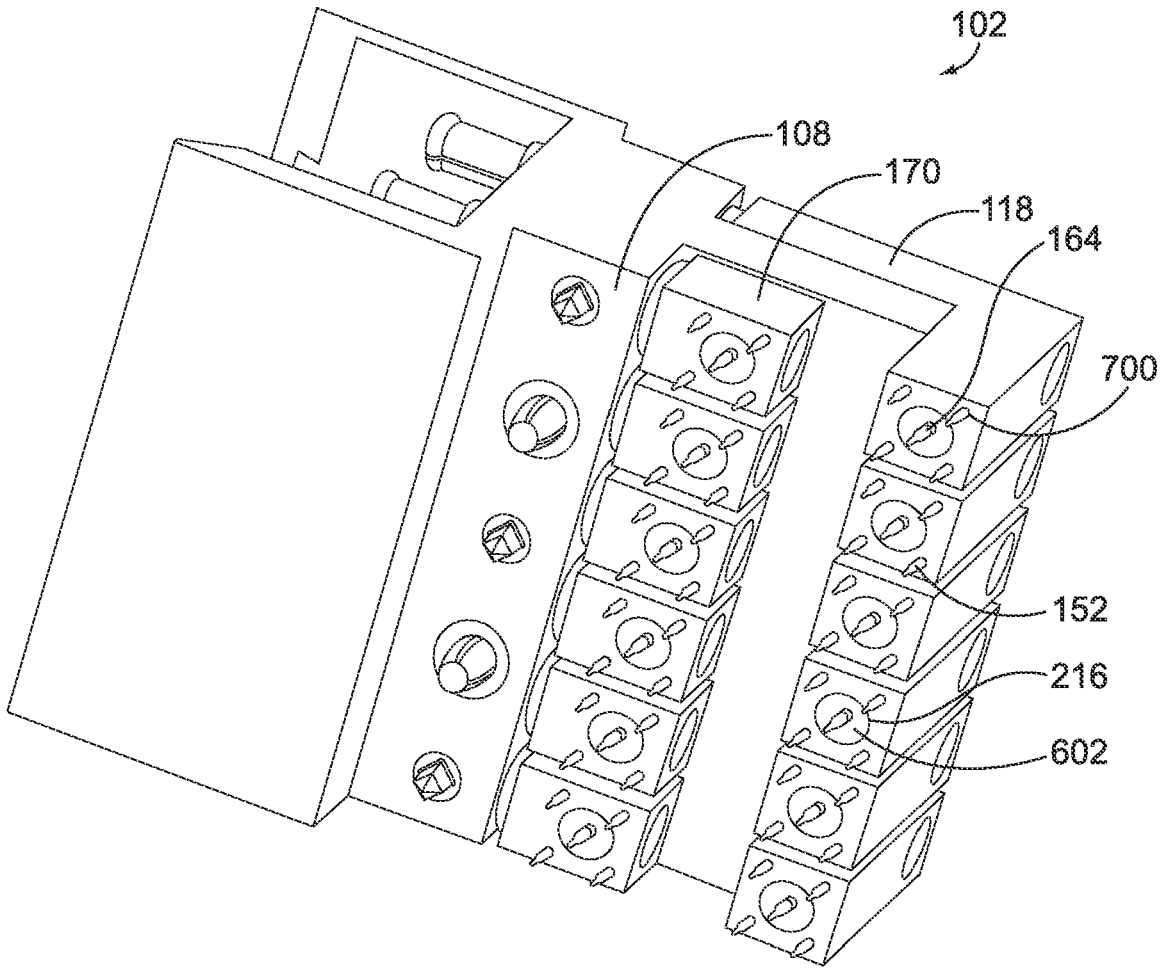
FIG. 7 is a perspective view of the plug connector assembly shown in FIG. 1 in accordance with one embodiment.

FIG. 7 is a perspective view of the plug connector assembly 102 in accordance with one embodiment. FIG. 7 illustrates the mounting interface 108 of the plug connector assembly 102, but the discussion herein also may apply to the mounting interface 112 (shown in FIG. 1) of the receptacle connector assembly 104 (shown in FIG. 1). In the illustrated embodiment, each of the connector modules 118, 170 includes several of the mounting pins 152 and one of the mounting pins 164 protruding from the mounting interface 108. The mounting pins 152 of each connector module 118, 170 are disposed around the periphery of the mounting pin 164 for the corresponding connector module 118, 170. Alternatively, a different number and/or arrangement of the mounting pins 152 and/or mounting pins 164 may be provided for each connector module 118, 170.

As described above, the mounting pins 152 may be grounding pins that electrically couple the connector modules 118, 170 with an electrical ground reference of a circuit board (not shown). The mounting pins 164 may be signal pins that electrically couple the center conductors 200 (shown in FIG. 2) that'extend through the connector modules 118, 170 with one or more electric traces (not shown) in the circuit board to communicate data and/or power signals between the center conductors 200 and the circuit board. The mounting pins 164 protrude from the bottom end 602 of the dielectric body 216. The mounting pins 152 are coupled to the connector modules 118, 170. For example, the mounting pins 152 may be press-fit into openings 700 in the connector modules 118, 170. The openings 700 may be slots or other cavities extending into the connector modules 118, 170 from the mounting interface 108. The openings 700 may be smaller than one or more dimensions of the mounting pins 152 so that the mounting pins 152 are secured in the openings 700 by an interference fit.

Figure 8:
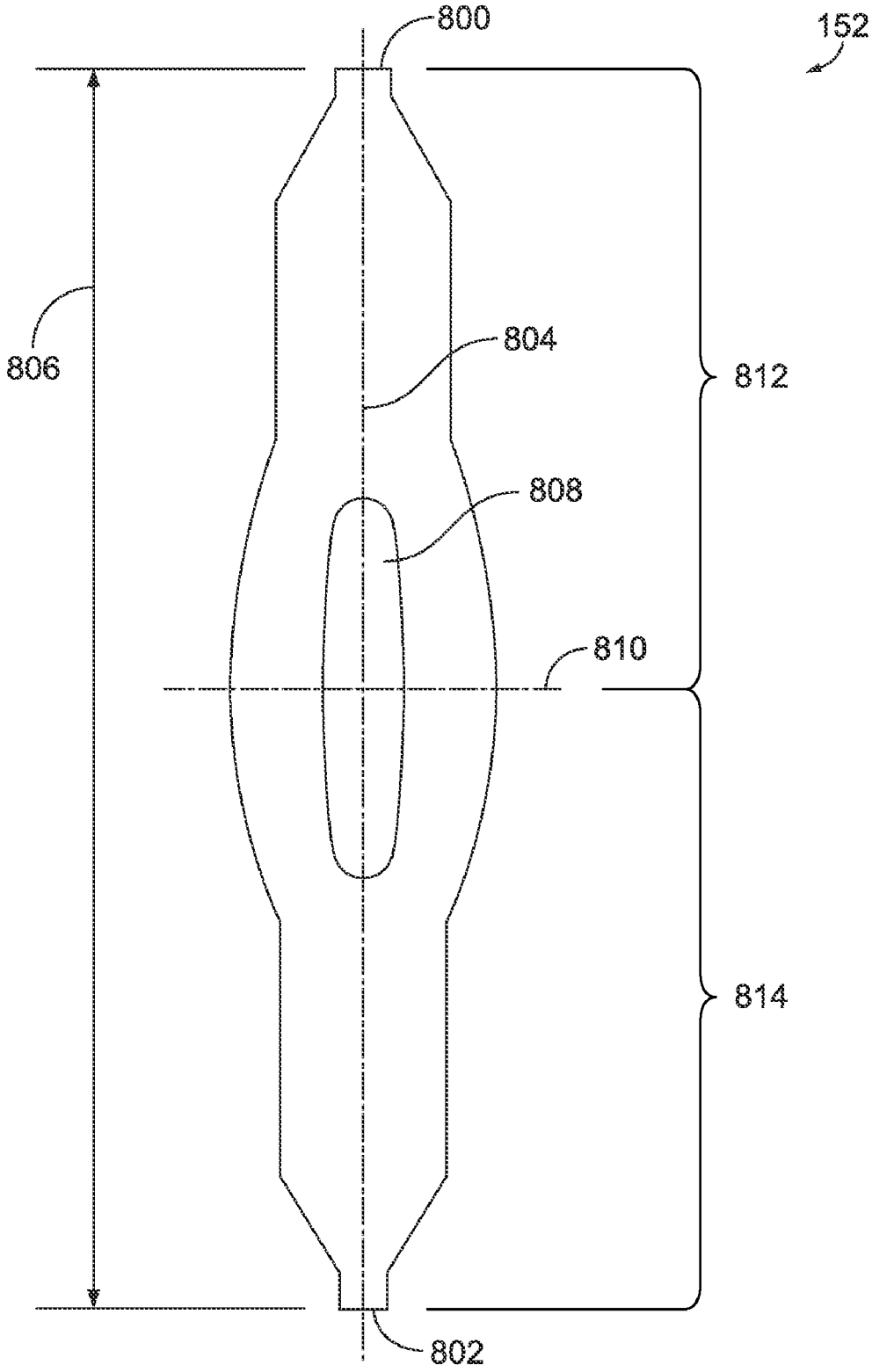
FIG. 8 is an elevational view of a mounting pin shown in FIG. 1 in accordance with one embodiment.

FIG. 8 is an elevational view of the mounting pin 152 in accordance with one embodiment. The mounting pin 152 extends from a top insertion end 800 to a bottom insertion end 802 along a center axis 804. A length dimension 806 is the distance between the insertion ends 800, 802 in a direction along the center axis 804. In the illustrated embodiment, the mounting pin 152 is an eye-of-needle pin with an opening 808 located between the insertion ends 800, 802. The top insertion end 800 is pressed into the mounting interface 108 (shown in FIG. 1) of the connector module 118, 150, 170, 172 to secure the mounting pin 152 to the corresponding connector module 118, 150, 170, 172. The bottom insertion end 802 is pressed into a circuit board (not shown) to electrically couple the mounting pin 152 and the connector module 118, 150, 170, 172 with a ground reference of the circuit board.

As shown in FIG. 8, the mounting pin 152 is substantially symmetrical about a bisecting plane 810. For example, a top half 812 of the mounting pin 152 has substantially identical dimensions as a bottom half 814 of the mounting pin 152. The top and bottom halves 812, 814 are separated by the bisecting plane 810. The bisecting plane 810 is oriented perpendicular to the center axis 804. The symmetrical shape of the mounting pin 152 may reduce the complexity involved in assembling the plug connector assembly 102 (shown in FIG. 1) and/or the receptacle connector assembly 104 (shown in FIG. 1) as either of the insertion ends 800, 802 may be press-fit into the plug connector assembly 102 and/or the receptacle connector assembly 104 to secure the mounting pin 152 thereto.

Figure 9:
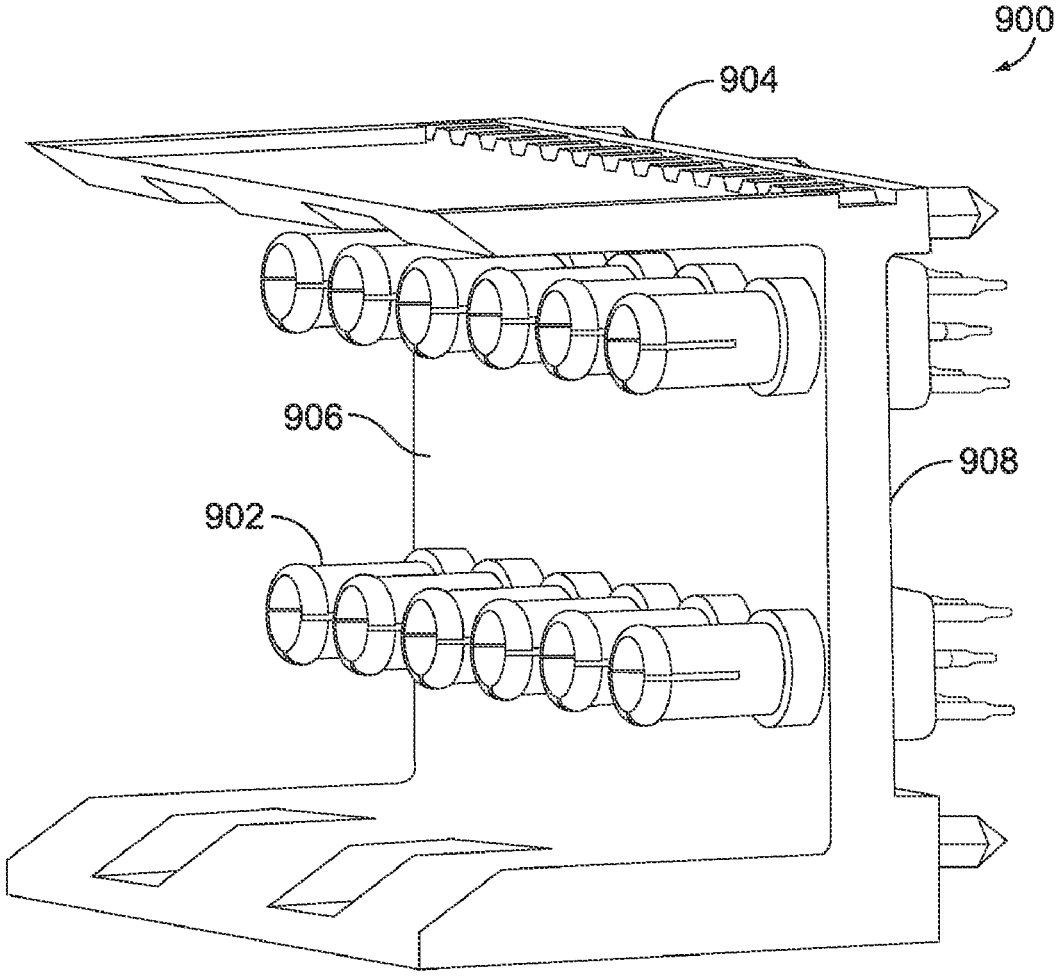
FIG. 9 is a perspective view of a vertically mounted plug connector assembly in accordance with an alternative embodiment.

FIG. 9 is a perspective view of a vertically mounted plug connector assembly in accordance with an alternative embodiment. The plug connector assembly 900 is similar to the plug connector assembly 102 shown in FIG. 1. For example, the plug connector assembly 900 includes a header assembly 904 with several plug connectors 902 disposed along a mating interface 906 of the header assembly 904. The plug connectors 902 may be coaxial connectors that are similar to the plug connectors 132, 166 (shown in FIG. 1). The plug connectors 902 extend through the header assembly 904 to a mounting interface 908. In contrast to the plug connector assembly 102, the mating interface 906 and mounting interface 908 of the plug connector assembly 900 are not angled with respect to one another. For example, the mating interface 906 is substantially parallel to the mounting interface 908, as opposed to the mating interface 906 being substantially perpendicular to the mounting interface 908.

The mounting interface 908 engages a circuit board (not shown) to mount the plug connector assembly 900 to the circuit board. The mating interface 906 engages the mating interface 110 (shown in FIG. 1) of the receptacle connector assembly 104 (shown in FIG. 1) to mate the plug connector assembly 900 with the receptacle connector assembly 104. The circuit boards to which each of the plug connector assembly 900 and the receptacle connector assembly 104 are mounted are disposed approximately perpendicular to one another.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second." and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing extending from a mating interface to a back end along a longitudinal axis and from a top side to a mounting interface along a vertical axis, the mounting interface configured to mount the housing to a circuit board;

an electrical connector disposed at the mating interface and configured to mate with a mating connector;

and a conductor extending from the electrical connector to the mounting interface to provide a conductive pathway between the mating connector and the circuit board, the conductor comprising a mating portion oriented along the longitudinal axis and a mounting portion oriented along the vertical axis, wherein one of the mating portion and the mounting portion comprises a bifurcated end having opposing contact tips and the other of the mating portion and the mounting portion comprises an interconnection end that is received between the contact tips to electrically couple the mating portion and the mounting portion;

wherein the housing comprises a dielectric header assembly extending from the mating interface to a rear face along the longitudinal axis and a conductive connector module extending from the rear face of the header assembly to the back end along the longitudinal axis and from the top side to the mounting interface along the vertical axis.

2. The assembly of claim 1, wherein the mating portion and the mounting portion are perpendicularly oriented with respect to one another.

3. The assembly of claim 1, wherein the mounting portion comprises a shoulder extending from the mounting portion in an angled direction with respect to the vertical axis, further comprising a dielectric body disposed in the housing and enclosing the mounting portion of the conductor along a length of the mounting portion, wherein the dielectric body comprises a slot extending into the dielectric body from a bottom end of the dielectric body that is disposed at the mounting interface, the slot receiving the shoulder of the mounting portion through the bottom end of the dielectric body.

4. The assembly of claim 1, wherein the housing includes a dielectric header assembly ravine the mating interface and a conductive connector module having the mounting interface with the conductor extending through the header assembly and the connector module, and further comprising a grounding pin press-fit into the mounting interface of the connector module to electrically join the housing with the circuit board.

5. The assembly of claim 1, further comprising a grounding pin coupled with the mounting interface to electrically join the housing with the circuit board, wherein the grounding pin is elongated along a center axis and is substantially symmetrical on both sides of a plane that is perpendicularly oriented with respect to the center axis.

6. The assembly of claim 1, wherein the electrical connector is a coaxial connector having a conductive shield shell circumferentially surrounding the conductor proximate the mating interface.

7. The assembly of claim 6, wherein an outer end of the mating portion located opposite of the interconnection end receives a contact pin of the mating connector and the shield shell of the electrical connector receives a conductive shield of the mating connector when the electrical connector and mating connector mate with one another.

8. The assembly of claim 6, wherein an outer end of the mating portion located opposite of the interconnection end is received into a tubular contact of the mating connector and the shield shell of the electrical connector is received into a conductive shield of the mating connector when the electrical connector and mating connector mate with one another.

9. The assembly of claim 1, wherein the conductor is electrically isolated from the connector module by a plurality of dielectric bodies.

10. The assembly of claim 1, wherein the header assembly comprises an alignment shroud projecting from the mating interface, the shroud configured to align the mating connector with the electrical connector prior to mating the electrical connector with the mating connector.

11. The assembly of claim 1, wherein the housing includes a conductive connector module and a plurality of dielectric bodies disposed within the connector module, the conductor extending through the connector module and separated from the connector module by the dielectric bodies.

12. The assembly of claim 1, wherein the housing includes a dielectric header assembly that includes a plurality of the electrical connectors disposed at the mating interface and first and second conductive connector modules that extend from the header assembly to the mounting interface, further comprising a plurality of the conductors extending through the header assembly and the first and second connector modules, wherein the first connector module is disposed between the second connector module and the circuit board when the housing is mounted to the circuit board.

13. An electrical connector assembly comprising:

a housing including a dielectric header assembly extending from a mating interface to a rear face alone a longitudinal axis and a conductive connector module extending from the rear face of the header assembly to a back end alone the longitudinal axis and from a top side to a mounting interface alone a vertical axis, the mounting interface configured to mount the housing to a circuit board;

an electrical connector disposed at the mating interface and configured to mate with a mating connector;

a dielectric body disposed in the housing at the mounting interface, the dielectric body including an axial opening extending along a length of the dielectric body and a slot oriented in an angled direction with respect to the length of the dielectric body; and a conductor extending from the electrical connector to the mounting interface to provide a conductive pathway between the mating connector and the circuit board, the conductor comprising a mounting pin configured to be mounted to the circuit board and a shoulder extending from the conductor and disposed at an angle with respect to the mounting pin, wherein the shoulder is received into the slot of the dielectric body.

14. The assembly of claim 13, wherein the conductor comprises a mating portion oriented along the longitudinal axis and a mounting portion oriented along the vertical axis, wherein one of the mating portion and the mounting portion comprises a bifurcated end having opposing contact tips and the other of the mating portion and the mounting portion comprises an interconnection end that is received between the contact tips to electrically couple the mating portion and the mounting portion.

15. The assembly of claim 14, wherein the mating portion and the mounting portion are perpendicularly oriented with respect to one another.

16. The assembly of claim 13, further comprising a grounding pin coupled with the mounting interface to electrically join the housing with the circuit board, wherein the grounding pin is press-fit into the mounting interface of the housing.

17. The assembly of claim 13, further comprising a grounding pin coupled with the mounting interface to electrically join the housing with the circuit board, wherein the grounding pin is elongated along a center axis and is substantially symmetrical on both sides of a plane that is perpendicularly oriented with respect to the center axis.

18. The assembly of claim 13, wherein the electrical connector is a coaxial connector having a conductive shield shell circumferentially surrounding the conductor in a location proximate to the mating interface.

19. The assembly of claim 18, wherein an outer end of the mating portion located opposite of the interconnection end receives a contact pin of the mating connector and the shield shell of the electrical connector receives a conductive shield of the mating connector when the electrical connector and mating connector mate with one another.

20. The assembly of claim 18, wherein an outer end of the mating portion located opposite of the interconnection end is received into a tubular contact of the mating connector and the shield shell of the electrical connector is received into a conductive shield of the mating connector when the electrical connector and mating connector mate with one another.

21. The assembly of claim 18, wherein the housing includes a plurality of dielectric bodies in the connector module, the conductor extending through the dielectric bodies and separated from the connector module by the dielectric bodies.

22. The assembly of claim 18, wherein the housing comprises a plurality of the conductive connector modules including first and second connector modules, further comprising a plurality of the electrical connectors and a plurality of the conductors extending from the electrical connectors and through the first and second connector modules, wherein the first connector module is disposed between the second connector module and the circuit board when the housing is mounted to the circuit board.

* * * * *